US010926576B2

(12) United States Patent
Franco et al.

(10) Patent No.: US 10,926,576 B2
(45) Date of Patent: Feb. 23, 2021

(54) RETRACTABLE BOUNDARY APPARATUS AND SYSTEM

(71) Applicant: COMSERO, INC., Denver, CO (US)

(72) Inventors: Anthony Franco, Broomfield, CO (US); Andrew Valentine, Wheat Ridge, CO (US)

(73) Assignee: COMSERO INC., Denver, CO (US)

( * ) Notice: Subject to any disclaimer, the term of this patent is extended or adjusted under 35 U.S.C. 154(b) by 231 days.

(21) Appl. No.: 16/138,584

(22) Filed: Sep. 21, 2018

(65) Prior Publication Data

US 2019/0084344 A1 Mar. 21, 2019

Related U.S. Application Data

(60) Provisional application No. 62/561,581, filed on Sep. 21, 2017.

(51) Int. Cl.

| | |
|---|---|
| ***B43L 7/00*** | (2006.01) |
| ***B43L 1/08*** | (2006.01) |
| ***B43K 23/00*** | (2006.01) |
| ***B43L 13/00*** | (2006.01) |
| ***B44D 3/38*** | (2006.01) |
| *B43L 1/12* | (2006.01) |

(52) U.S. Cl.
CPC ..... *B43L 1/08* (2013.01); *B43K 23/001* (2013.01); *B43L 7/002* (2013.01); *B43L 13/00* (2013.01); *B43L 13/005* (2013.01); *B44D 3/38* (2013.01); *B43L 1/123* (2013.01)

(58) Field of Classification Search
CPC ..... B43L 7/002; B43L 7/007; B44D 3/38
USPC ..... 33/413, 1 G, 1 LE, 756, DIG. 1
See application file for complete search history.

(56) References Cited

U.S. PATENT DOCUMENTS 2,107,989 A * 2/1938 Kuhn ..... A01G 20/30 33/413
2,788,584 A * 4/1957 Adrien ..... B41F 27/005 33/645
3,078,581 A * 2/1963 Foster ..... B44D 3/38 33/414
3,110,917 A 11/1963 Mcpeek
4,100,684 A 7/1978 Berger
(Continued)

FOREIGN PATENT DOCUMENTS

FR 2679949 A3 * 2/1993 ..... B44D 3/38

OTHER PUBLICATIONS

Office Action dated Nov. 30, 2018 in U.S. Appl. No. 16/138,487.

*Primary Examiner* — Christopher W Fulton
(74) *Attorney, Agent, or Firm* — Dorsey & Whitney LLP

(57) ABSTRACT

Certain embodiments of the invention include an apparatus for creating a line. Certain embodiments of an apparatus include two or more reels having an extendable and retractable cord. Pulling the two or more reels apart allows for the creation of a line of various sizes. In certain embodiments, the two reels share a single cord. In certain embodiments, a first reel has a first cord with a first attachment end that joins with another attachment end. Certain embodiments include a reel with a magnet, allowing attachment to a magnetic surface. Certain embodiments of the invention include a system for creating a line. In certain embodiments, the system includes an apparatus, and a pin having a magnet. Certain embodiments of the pin help to change the direction of the cord.

10 Claims, 3 Drawing Sheets

(56) References Cited

U.S. PATENT DOCUMENTS 4,207,646 A 6/1980 Osborne
4,415,092 A 11/1983 Boyer
4,875,591 A 10/1989 Mikesell
5,072,483 A 12/1991 Durand
5,193,288 A * 3/1993 Stifnell ..... G01B 5/207 33/413
5,269,083 A 12/1993 Vampatella et al.
5,432,973 A 7/1995 Wagner et al.
5,509,616 A 4/1996 Millen et al.
5,535,960 A 7/1996 Skowronski et al.
5,598,727 A 2/1997 White
5,775,919 A 7/1998 Gardner
5,833,165 A 11/1998 Paugh
5,836,038 A 11/1998 Thorp
5,947,304 A 9/1999 Thorp
5,954,288 A 9/1999 Shih
6,007,891 A 12/1999 Davis et al.
6,056,468 A 5/2000 Niewiadomski
6,186,461 B1 2/2001 Pelaez
6,199,784 B1 3/2001 Wang et al.
6,199,785 B1 3/2001 Paugh
6,290,158 B1 9/2001 Huang
6,325,665 B1 12/2001 Chung
6,364,237 B1 4/2002 Kagel
6,434,843 B1 * 8/2002 Shor ..... B44D 3/38 33/413
6,439,490 B1 8/2002 Hwang
6,616,080 B1 9/2003 Edwards et al.
6,694,922 B2 2/2004 Walter et al.
6,793,430 B1 9/2004 Liu
6,929,209 B2 8/2005 Baumgarten
7,007,882 B2 3/2006 Raia et al.
7,309,181 B2 12/2007 Hawkins
7,374,123 B2 5/2008 Han
7,661,620 B2 2/2010 Fields
7,665,684 B2 2/2010 Salentine et al.
7,755,483 B2 7/2010 Schmidt
7,762,215 B2 7/2010 Horton
7,913,408 B2 * 3/2011 Grisham ..... B44D 3/38 33/414
7,967,520 B2 6/2011 Hawkins
8,032,966 B1 10/2011 Keller
D663,776 S 7/2012 Lira-Nunez et al.
D669,937 S 10/2012 Lira-Nunez et al.
8,402,925 B2 3/2013 Le
8,534,587 B2 9/2013 He
8,746,519 B2 6/2014 Young et al.
8,757,532 B2 6/2014 Votel et al.
8,966,774 B2 * 3/2015 Choi ..... G01C 15/04 33/1 G
9,409,437 B2 8/2016 Green et al.
10,434,363 B2 * 10/2019 Parker ..... A63B 69/0028
2004/0032741 A1 2/2004 Tai
2005/0072009 A1 * 4/2005 Doublet ..... G01C 15/12 33/1 G
2005/0223582 A1 * 10/2005 Baugh ..... G01B 3/1003 33/764
2007/0278265 A1 12/2007 Contente
2008/0035778 A1 2/2008 Belden et al.
2008/0042000 A1 2/2008 Horton
2008/0120922 A1 5/2008 Sullivan et al.
2008/0166173 A1 7/2008 Gibbons
2008/0283651 A1 11/2008 Ito et al.
2009/0193629 A1 8/2009 Suenaga
2009/0250575 A1 10/2009 Fullerton et al.
2010/0068422 A1 3/2010 Keyes
2013/0008392 A1 1/2013 Holmstrom
2013/0074299 A1 3/2013 Rojdev
2014/0000322 A1 1/2014 Williams
2014/0007440 A1 * 1/2014 Cain ..... E04G 21/1825 33/413
2014/0377736 A1 12/2014 Essen et al.
2015/0223588 A1 8/2015 Denittis et al.
2016/0073796 A1 3/2016 Nesbitt
2017/0022025 A1 1/2017 Burner et al.
2019/0009610 A1 * 1/2019 Papp ..... B44D 3/38
2019/0030945 A1 * 1/2019 Fox ..... B44D 3/38

* cited by examiner

RETRACTABLE BOUNDARY APPARATUS AND SYSTEM

CROSS REFERENCE TO RELATED APPLICATIONS

This application claims the benefit of U.S. Provisional Patent Application 62/561,581, filed on Sep. 21, 2017, which is hereby incorporated by reference in its entirety.

FIELD OF THE INVENTION

Embodiments of the invention generally relate to the field of writing implements, and more particularly to dry erase white boards and the like.

BACKGROUND OF THE INVENTION

Dry erase boards typically include a board or substrate. The board or substrate is optionally coated with an enamel, film, plastic, ultraviolet cured liquid, liquid varnish, or porcelain finish, and the like. Specially designed markers are used to write on the board or substrate. While the ink of the marker dries on the substrate, the ink does not bond to the substrate surface. Thus, writing is easily removed with a soft eraser, cloth, finger, etc.

During collaborative sessions, meetings, presentations, and the like, participants can contribute to the discussion by writing, erasing, and otherwise interacting with the dry erase board. During brainstorming sessions, for example, participants typically share, or use their own dry erase marker to write down and contribute ideas. In some situations, participants use pieces of paper with adhesive (commonly known as sticky notes). Ideas are written on sticky notes, and placed on the board. Sticky notes allow for ideas to be moved around on the board, such that similar ideas can be placed in proximity. Sticky notes also allow for certain ideas to be separated from one another, or organized using the area available on the board.

Although sticky notes allow for rapid attachment and removal from a dry erase board, sticky notes are typically one-time use. Because sticky notes are made of paper, using a pen or marker permanently marks each sticky note. Though a pencil and rubber eraser can be used on sticky notes, it is often inefficient to do so.

Additionally, when categorizing, storing, or otherwise organizing ideas on a board, lines may be drawn to separate concepts. For example, during a collaborative session, information may be organized by drawing out the lines that comprise the rows and columns of a table. In another example, participants may write or draw out separate set of lists, where each set is divided by lines. Participants may contribute ideas to the board by writing within the lines, next to the lines, or otherwise in proximity to the lines. Participants may also use sticky notes, by moving the notes around the dry erase board and within the drawn lines. Using lines during a collaborative session allows participants to quickly view ideas, better organize ideas, and have better collaborative outcomes.

However, there are some disadvantages to using drawn lines on dry erase boards. Unless care is taken to draw the line, drawn lines are seldom neat or straight. A tool, such as a straight edge may be used, but such tool is not always readily available. The drawn lines are susceptible to being accidentally erased. Unintentional erasure may lead to lost information. Drawn lines are also more difficult to change.

A participant must erase the line, and redraw the line. Erasing the line may lead to accidental erasure of important information.

When working in a fast-paced collaborative environment, establishing lines quickly and efficiently becomes a priority.

Several patents and patent publications describe a retractable cord and similar devices. For example, U.S. Pat. No. 9,718,640 and U.S. Patent Publication No. 2017/0022025 to Burner et al., entitled "Retractable Badge Reel with Button Display," and incorporated herein by reference, generally discloses a badge reel having a spring-retractable cord configured to hold a badge. The reel includes a recess configured to house a magnet. However, this reference is limited to a self-retractable cord attachment to an object, such as a badge.

U.S. Pat. No. 6,290,158 to Huang, entitled "Reel Device Carried on One's Person," and incorporated herein by reference, generally discloses a reel having an internal pulling rope with a clip or clamp for attachment. A swivel action is provided by the configuration of the clamp attachment to the reel. However, this reference is limited to the attachment of the reel through a clamp, and for the connection to a decorative piece of various modeling decorations.

A number of patents and patent publications describe a general retractable cord device. These references include, for example: U.S. Pat. No. 5,535,960 to Skowronski et al., incorporated by reference, describing a "Cord Reel Assembly"; U.S. Pat. No. 5,509,616 to Millen Jr. et al., incorporated by reference, describing a "Retractable Chalk Line Device"; U.S. Pat. No. 5,598,727 to White, incorporated by reference, describing a "Locks for Bicycles and the Like"; U.S. Pat. No. 5,833,165 to Paugh, incorporated by reference, describing a "Retraction Reel for Keys and the Like"; U.S. Pat. No. 5,954,288 to Shih, incorporated by reference, describing a "Extensible Hanging Device"; U.S. Pat. No. 6,199,784 to Wang et al., incorporated by reference, describing a "Automatically Rewindable Wire Device"; U.S. Pat. No. 6,199,785 to Paugh, incorporated by reference, describing a "Ratchet Mechanism for a Reel"; U.S. Pat. No. 6,325,665 to Chung et al., incorporated by reference, describing a "Power Adapter with Cable Storage Device"; U.S. Pat. No. 6,364,237 to Kagel, incorporated by reference, describing a "Retractable Badgeholder with Spinning Display"; U.S. Pat. No. 6,439,490 to Hwang, incorporated by reference, describing a "Wire Reeler"; U.S. Pat. No. 6,616,080 to Edwards et al., incorporated by reference, describing a "Retractable Cord Device"; U.S. Pat. No. 6,694,922 to Walter et al., incorporated by reference, describing a "Retractable Leash Assembly"; U.S. Pat. No. 6,929,209 to Baumgarten, incorporated by reference, describing a "Self-Orienting Retractable ID Card Holder"; U.S. Pat. No. 7,007,882 to Raia et al., incorporated by reference, describing a "Retractable Badge Reel with Billboard Display"; U.S. Pat. No. 7,374,123 to Han, incorporated by reference, describing a "Rewind Mechanism"; U.S. Pat. No. 7,661,620 to Fields, incorporated by reference, describing a "Personal Accessory Carrying Device"; U.S. Pat. No. 7,665,684 to Salentine et al., incorporated by reference, describing a "Retracting Tether for Cell Phones, Pagers and PDA's"; U.S. Pat. No. 7,755,483 to Schmidt et al., incorporated by reference, describing a "Article Holding and Tracking Device"; U.S. Pat. No. 7,762,215 to Horton et al., incorporated by reference, describing a "Universal Retractable Zip Clip"; U.S. Pat. No. 8,402,925 to Le Croix et al., incorporated by reference, describing a "Retractable Animal Leash"; U.S. Pat. No. 8,534,587 to He, incorporated by reference, describing a "Automatic Positioning Winder"; U.S. Pat. No.

8,746,519 to Young et al., incorporated by reference, describing a "Releasable Attachment Apparatus"; U.S. Pat. No. 8,757,532 to Votel et al., incorporated by reference, describing a "Retractable Lanyard"; U.S. Patent Publication No. 2004/0032741 to Tai, incorporated by reference, describing a "Lamp Reel"; U.S. Patent Publication No. 2007/0278265 to Contente, incorporated by reference, describing a "System for Carrying Portable Device"; U.S. Patent Publication No. 2008/0035778 to Belden et al., incorporated by reference, describing a "Swivel Recoiler"; U.S. Patent Publication No. 2008/0042000 to Horton, incorporated by reference, describing a "Universal Retractable Zip Clip"; U.S. Patent Publication No. 2008/0283651 to Ito et al., incorporated by reference, describing a "Hanging Device"; U.S. Patent Publication No. 2013/0008392 to Holmstrom, incorporated by reference, describing a "Retractable Leash System"; U.S. Patent Publication No. 2014/0000322 to Williams, incorporated by reference, describing a "Mobile Lock with Retractable Cable"; and U.S. Patent Publication No. 2015/0223588 to DeNittis et al., incorporated by reference, describing a "Identification Badge Holder." However, again, the references generally describe and teach the attachment of the retractable device to, for example, a badge, ID holder, phone, and pet.

Therefore, there is a need for a system and apparatus that allows users to rapidly create straight lines for a dry erase board. There is a need for an apparatus that creates consistently straight lines. There is a need for a system and apparatus that allows easy modification of the lines. There is also a need for an apparatus that allows ideas to be linked efficiently.

SUMMARY OF THE INVENTION

It is the object of certain embodiments of the invention to provide a system and apparatus for quickly and effectively imparting a line or a plurality of lines, and be used on a dry erase board. It is the object of certain embodiments to provide a system and apparatus for imparting consistent, straight lines. It is also the object of certain embodiments to quickly modify the lines as to create shapes. It is also the object of certain embodiments to quickly adjust, move, or otherwise modify the imparted line, and in some cases, to do so without leaving a mess. It is also the object of the invention to impart a line effortlessly, and anywhere across a surface of a dry erase board.

Certain embodiments of the invention include an apparatus for creating a line. Certain embodiments of an apparatus include two or more reels having an extendable and retractable cord. Pulling the two or more reels apart allows for the creation of a line of various sizes. In certain embodiments, an apparatus includes a cord attached to one or more reels. In certain embodiments, a cord is extendable from a first reel and a second reel. In certain embodiments, the two reels share a single cord.

In certain embodiments, a first reel has a first cord with a first attachment end that joins with another attachment end. Certain embodiments include a reel with a magnet, allowing attachment to a magnetic surface. Certain embodiments of the invention include a system for creating a line. In certain embodiments, the system includes an apparatus, and a pin having a magnet. Certain embodiments of the pin help to change the direction of the cord.

These and other advantages described in the Summary will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION

Figure 1A:
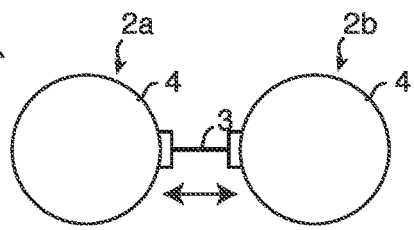
FIG. 1A: A line creating apparatus in certain embodiments of the invention.
Figure 1B:
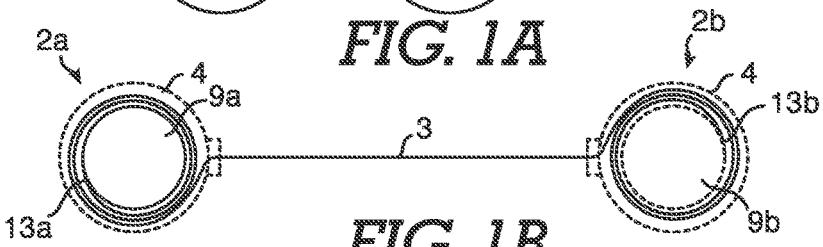
FIG. 1B: An internal mechanism of a line creating apparatus in certain embodiments of the invention.

Referring to FIG. 1A, in certain embodiments, a line creating apparatus 1 includes a cord attached to one or more reels. As shown in FIG. 1A, a line creating apparatus includes a first reel 2*a* and a second reel 2*b*. A reel 2*a*, 2*b* includes a cord 3 extendable from the reel housing 4. Referring to, for example, FIG. 5, a cord 3 passes through an opening 7 located on a surface of the housing 4. In certain embodiments, the line creating apparatus 1 shares a cord 3 between a first reel 2*a* and a second reel 2*b*. Referring to FIG. 1B, the reel housing 4 stores the length of the cord 3, for example, by encircling a spool 9*a*, 9*b*, located in a first reel 2*a* and a second reel 2*b*. In certain embodiments, a first end 13*a* of a cord 3 is attached to a first spool 9*a*, and a second end 13*b* of a cord 3 is attached to a second spool 9*b*. In certain embodiments, a segment of a cord 3 is partially wound on a first spool 9*a*, and another segment is partially wound on a second spool 9*b*, such that the reels 2*a*, 2*b* are in proximity to one another when in the line creating apparatus is in a resting or non-extended position.

Figure 10:
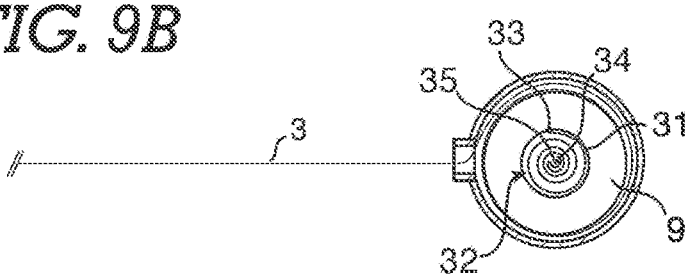
FIG. 10: A sectional view of a reel in certain embodiments.

Referring to FIG. 10, in certain embodiments, a reel as described herein includes a spiral torsion spring 32. In certain embodiments, a spring 32 is located within the annular opening 31 of the spool 9. A spring 32 has a first end 33 affixed to a spool 9, and a second end 34 affixed to a housing, for example, to a post 35. The spool is rotatable within the housing, and the spring 32 biases the rotation of the housing towards a certain direction when the spring is loaded. Extension of a cord out of the housing spins the spool 9 about a central axis and loads the spring. The loaded spring provides a force to retract 3 the cord back into the housing. In certain embodiments, the line creating apparatus includes reels that contain springs with substantially similar spring constants. Having substantially similar spring constants allows each reel to impart an equal and opposite force, and effectively allowing any point on a cord to remain stationary. In certain embodiments, in line creating apparatuses where the reels share a cord (as seen, for example, in FIG. 1A and FIG. 1B), the orientation of the springs (either rotating clockwise or counterclockwise) found in the first reel and second reel may be the same (both rotating in the same direction), or may be opposing (one rotating clockwise, one rotating counterclockwise).

Figure 2:
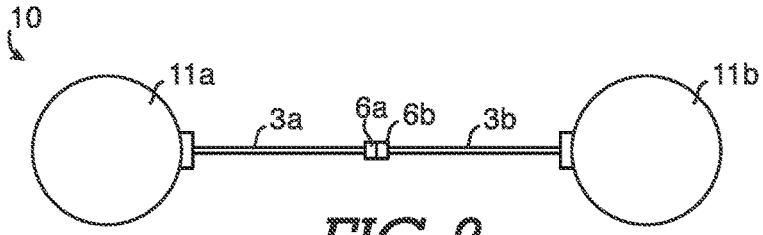
FIG. 2: A line creating apparatus in certain embodiments of the invention.
Figure 3:
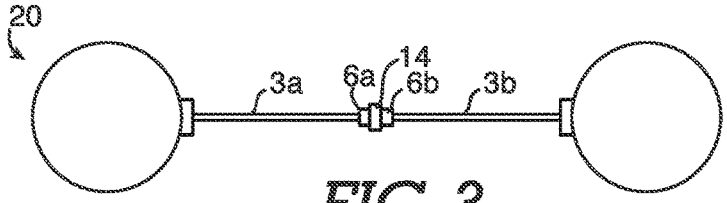
FIG. 3: A line creating apparatus in certain embodiments of the invention.
Figure 4:
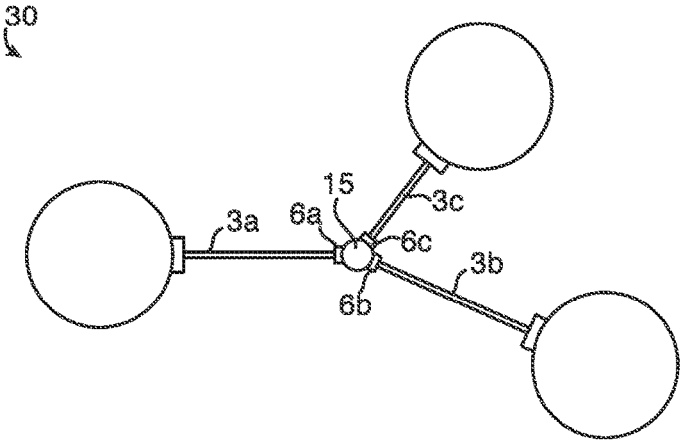
FIG. 4: A line creating apparatus in certain embodiments of the invention.

In an embodiment of the invention, the orientation and location of the springs allows for the placement of an identification apparatus, such as a marker. The intersection point of two or more cords, each linking two housings each containing a spool and spring, allows for a point of reference to be held in place at an intersection point. In an embodiment, the multiple springs allow for the placement of an identification apparatus, located at a point on the cord, held in place at any point on the straight line between each of the housings at either end. The present inventor has recognized that the multi-springed apparatus, whereby two housings at either end of a cord each contain a spring and a spool, allow for placement of a marker piece at any point in contact with the cord between a plurality of housings and/or spools. In varying embodiments of the invention, the identification apparatus takes the form of the coupling 14, and/or any part of the combination of one or more attachment ends 6*a*, 6*b*, as depicted in FIGS. 2 and 3. In an alternative embodiment, where more than one cord intersects, the identification apparatus takes the form of a coupling 15 that exists at the intersection point between the two or more cords, as depicted in FIG. 4.

Referring to FIG. 2, in certain embodiments, a line creating apparatus 10 has a first reel 11*a* and a second reel 11*b*. A first reel 11*a* has a first cord 3*a*, where the first cord 3*a* terminates at a first attachment end 6*a*. Still referring to FIG. 2, a second reel 11*b* has a second cord 3*b*, where the second cord 3*b* terminates at a second attachment end 6*b*. The attachment ends 6*a*, 6*b* attach to each other through an attachment feature. The attachment feature includes, but is not limited to, magnets, compressive fit, pin and slot connection, and pin and hole connection. The cords 3*a*, 3*b* are extendable from the first reel 11*a* and second reel 11*b*.

Referring to FIG. 3, in certain embodiments of the invention, a line creating apparatus 20 has a coupling 14. As shown in FIG. 3, a coupling 14 joins attachment ends 6*a*, 6*b* located on cords 3*a*, 3*b*. Referring to FIG. 4, in certain embodiments of the invention, a line creating apparatus 30 has a coupling 15. As shown in FIG. 4, a coupling 15 joins attachment ends attachment ends 6*a*, 6*b*, 6*c* located on cords 3*a*, 3*b*, 3*c*. In certain embodiments, a coupling 15 connects a plurality of attachment ends. It will be appreciated that in certain embodiments, coupling 15 is provided in a number of different sizes, in order to accommodate a plurality of attachment ends.

Figure 5:
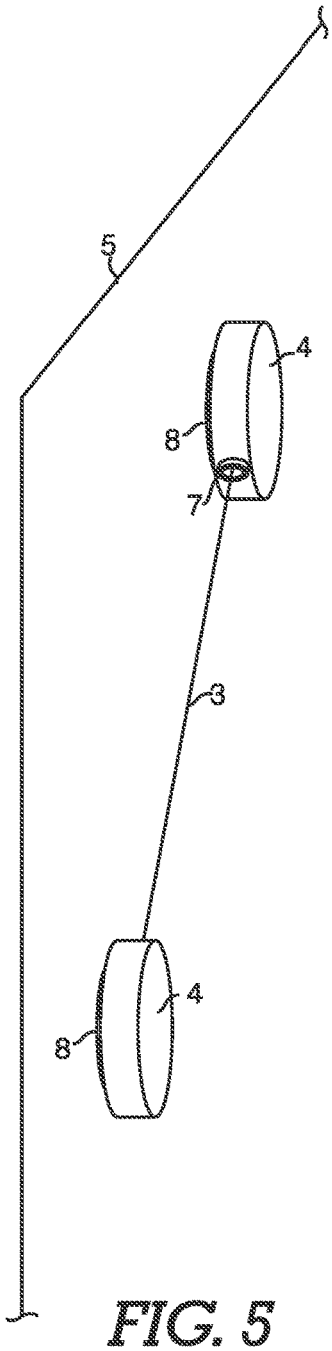
FIG. 5: Perspective view of a line creating apparatus on a surface in certain embodiments of the invention.

Referring to FIG. 5, certain embodiments are attached to a surface 5. In certain embodiments, the surface 5 has magnetic properties. For example, a surface 5 includes, but is not limited to a magnetic sheet, a magnetic white board, and a magnetic wall. The housing 4 of a reel has a magnet 8 allowing attachment and detachment from a surface 5. The length of the cord can be adjusted by adjusting the placement of the reel along the surface.

Figure 6:
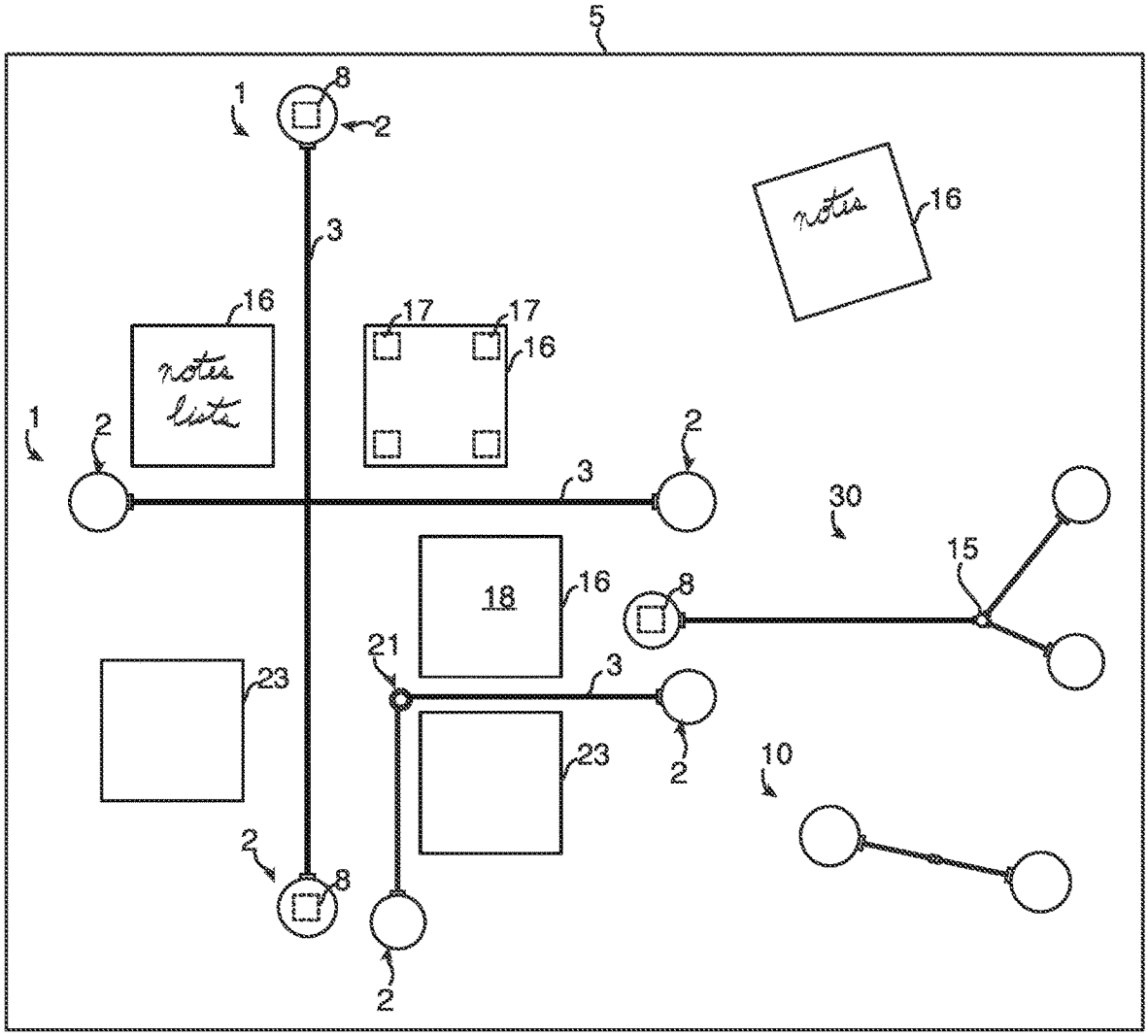
FIG. 6: A front view of a system including a line creating apparatus on a surface in certain embodiments of the invention.

Referring to FIG. 6, certain embodiments comprise a system of a plurality of line drawing apparatuses. For example, as seen in FIG. 6, the system includes one or more apparatuses 1, 10, 30. In certain embodiments, the system includes a tile 16 or panel having a magnet 17, where a face 18 has a surface for writing with a writing utensil or implement. The tile is attached to a surface 5 having magnetic properties. A line creating apparatus 1 (also, for example, a line creating apparatus 10, 30) is further attached to the surface 5 through a magnet 8. Still referring to FIG. 6, the line creating apparatus 1 creates a line with the cord 3 located between reels 2. The placement of one reel relative to a second reel determines the length of the cord 3, as well as the angle of the cord on a surface 5. Generally, the apparatus allows flexibility in placement of the cord. Additionally, a user can place a plurality of tiles 16 or a plurality of sticky notes 23 on a surface, and divide such plurality of tiles and sticky notes with the line creating apparatus. In certain embodiments, cords are provided in different colors. For example, cords of one color may allow a user to distinguish it from cords of another color.

Figure 7:
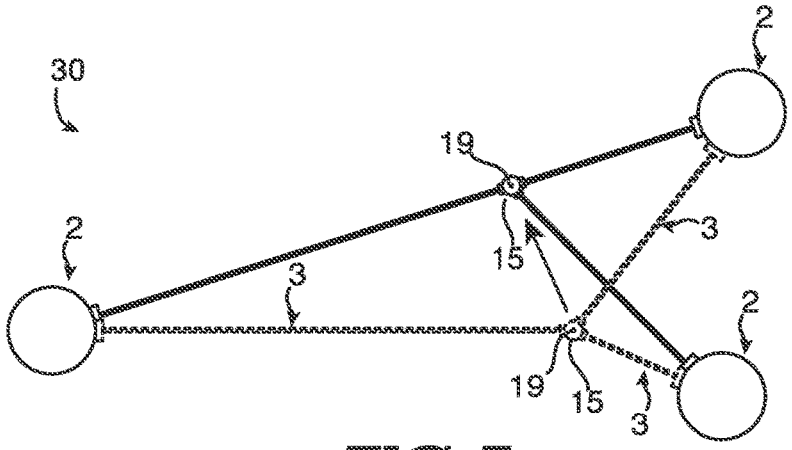
FIG. 7: An example of a line creating apparatus embodiment in use.

Referring to FIG. 7, in certain embodiments, the line creating apparatus 30 includes three or more reels 2, where each reel has a cord 3 attached to a coupling 15. The location that the cords converge may be referred to as a focal point 19. In certain embodiments, the reels 2 contain springs that have substantially similar spring constants. In certain embodiments, a coupling 15 includes a magnet. Translocation of the focal point 19 from a first point to a second point, as illustrated in FIG. 7, allows the focal point 19 to remain stationary at a new position, depending on the location of the new position. In certain embodiments, a pin 21 helps to keep the coupling 15 stationary at a focal point.

Figure 8A:
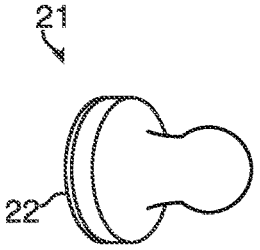
FIG. 8A: A perspective view of a pin in certain embodiments of the invention.
Figure 8B:
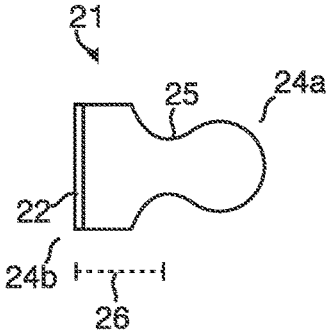
FIG. 8B: A side view of a pin in certain embodiments of the invention.
Figure 8C:
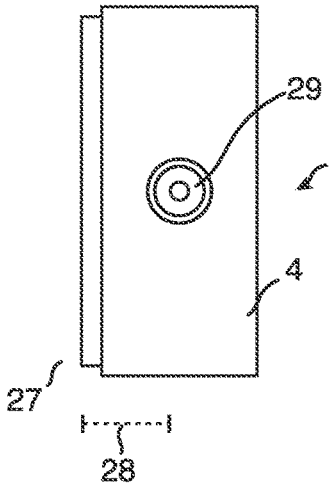
FIG. 8C: A side view of a reel in certain embodiments of the invention.
Figure 9A:
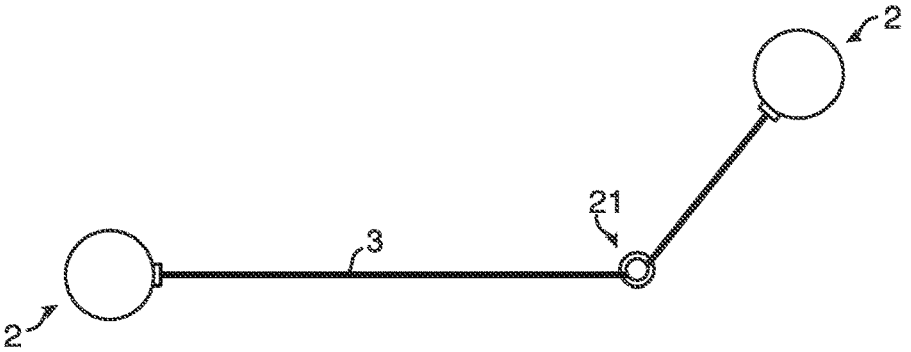
FIG. 9A: A front view of a pin and line creating apparatus in certain embodiments of the invention.
Figure 9B:
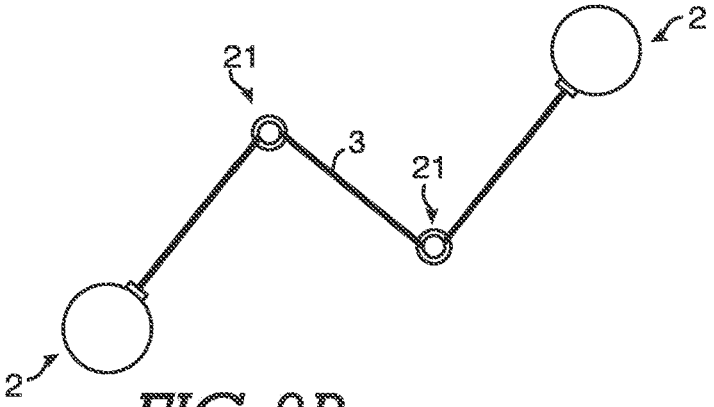
FIG. 9B: A front view of a pin and line creating apparatus in certain embodiments of the invention.

In certain embodiments, a line creating system includes a pin 21. Referring to FIG. 8A and FIG. 8B, the pin 21 has a first end 24*a* and a second end 24*b*, where the second end 24*b* includes a magnet 22. The pin 21 has an indent 25 to accommodate a cord 3. Referring to FIG. 8B and FIG. 8C, the distance 26 between an indent 25 and the pin second end 24*b* is substantially similar with the distance 28 between a reel 2 bottom end 27 and the opening 29 located on the reel housing 4. Referring to FIG. 6, FIG. 9A, and FIG. 9B, during use, the pin 21 can affect the linear direction of the cord 3. The placement of the pin 21 between the reel 2 allows adjustment of the length, as well as the linear direction of the cord.

EXAMPLES

Example 1

During a brainstorming session, the tiles may serve as a surface for writing notes. The line creating apparatus 1 (also, for example, line creating apparatus 10, 20, 30) may act as a boundary to separate out the content written on the tiles. The apparatus allows effective organization of ideas, and leading to an effective outcome from the session. Referring to FIG. 6, a system includes a line creating apparatus 1 and a pin 21. The interplay of the line creating apparatus 1 and pin 21 as well as the tile 16 and sticky notes 23 allows for a more dynamic interaction with a surface 5.

Example 2

During a product development meeting, new improvements for a product are written on a magnetic dry-erase board. The improvements are listed on various parts of the board. The reel of the apparatus is placed on certain improvements. A first reel is connected with a second reel, and further connected with a third reel to "connect" two or more ideas together.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A line establishing apparatus, comprising:

a first reel, the first reel further comprising:

a first housing, a first spool, a first torsion spring, and a cord; the first spool further comprising an annular opening, the first torsion spring having a first end and a second end, the first torsion spring positioned within the first spool annular opening, the first end of the first torsion spring affixed to the first housing, and the second end of the first torsion spring affixed to the first spool, the first spool rotatable within the first housing, the cord further comprising a first end and a second end, the cord first end attached to the first spool, and partially wound about the first spool, the cord exiting the first housing through a first housing opening;

a second reel, the second reel further comprising:

a second housing, a second spool, and a second torsion spring; the second spool further comprising an annular opening, the second torsion spring having a first end and a second end, the second torsion spring positioned within the second spool annular opening, the first end of the second torsion spring affixed to the second housing, and the second end of the second torsion spring affixed to the second spool, the second spool rotatable within the second housing, the cord second end attached to the second spool, and partially wound about the second spool, the cord exiting the second housing through a second housing opening; and a pin comprising:

a magnet; and a first end and a second end, wherein the cord is configured to be received around the pin between the first end and the second end.

2. The line establishing apparatus of claim 1, further comprising an identification apparatus held in place on the cord at a point between the first reel and second reel.

3. The line establishing apparatus of claim 1, wherein the first housing comprises an attachment mechanism to secure the first reel to a surface.

4. The line establishing apparatus of claim 3, wherein the first attachment mechanism is a magnet.

5. The line establishing apparatus of claim 3, wherein the surface is a white board.

6. A line establishing apparatus, comprising:

a first reel, the first reel further comprising:

a first housing, a first spool, a first torsion spring, and a first cord; the first spool further comprising an annular opening, the first torsion spring having a first end and a second end, the first torsion spring positioned within the first spool annular opening, the first end of the first torsion spring affixed to the first housing, and the second end of the first torsion spring affixed to the first spool, the first spool rotatable within the first housing, the first cord further comprising a first end and a second end, the first cord first end attached to the first spool, and partially wound about the first spool, the first cord exiting the first housing through a first housing opening, the first cord second end attached to a first attachment end;

a second reel, the second reel further comprising:

a second housing, a second spool, a second torsion spring and a second cord; the second spool further comprising an annular opening, the second torsion spring having a first end and a second end, the second torsion spring positioned within the second spool annular opening, the first end of the second torsion spring affixed to the second housing, and the second end of the second torsion spring affixed to the second spool, the second spool rotatable within the second housing, the second cord further comprising a first end and a second end, the second cord first end attached to the second spool, and partially wound about the second spool, the second cord exiting the second housing through a second housing opening, the second cord second end attached to a second attachment end;

wherein the first attachment end attaches to a second attachment through an attachment feature; and a magnetic pin configured to receive at least one of the first cord or the second cord.

7. The line establishing apparatus of claim 6, wherein the attachment feature comprises a magnet.

8. The line establishing apparatus of claim 6, wherein:

the first housing comprises a first attachment mechanism to releasably couple the first reel to a surface; and the second housing comprises a second attachment mechanism to releasably couple the second reel to the surface.

9. The line establishing apparatus of claim 8, wherein the first attachment mechanism and the second attachment mechanism are both magnets.

10. A system for establishing a line, comprising:

a line establishing apparatus, further comprising:

a first reel, the first reel further comprising:

a first housing, a first spool, a first torsion spring, and a first cord; the first spool further comprising an annular opening, the first torsion spring having a first end and a second end, the first torsion spring positioned within the first spool annular opening, the first end of the first torsion spring affixed to the first housing, and the second end of the first torsion spring affixed to the first spool, the first spool rotatable within the first housing, the first cord further comprising a first end and a second end, the first cord first end attached to the first spool, and partially wound about the first spool, the first cord exiting the first housing through a first housing opening, the first cord second end attached to a first attachment end;

a second reel, the second reel further comprising:

a second housing, a second spool, a second torsion spring and a second cord; the second spool further comprising an annular opening, the second torsion spring having a first end and a second end, the second torsion spring positioned within the second spool annular opening, the first end of the second torsion spring affixed to the second housing, and the second end of the second torsion spring affixed to the second spool, the second spool rotatable within the second housing, the second cord further comprising a first end and a second end, the second cord first end attached to the second spool, and partially wound about the second spool, the second cord exiting the second housing through a second housing opening, the second cord second end attached to a second attachment end;

wherein the first attachment end attaches to a second attachment through an attachment feature; and a pin, said pin comprising a first end and a second end;

an indent located between the first end and the second end, said indent configured to receive the cord; and the second end comprising a magnet.

* * * * *